United States Patent [19]

Boehmke

[11] 4,071,543

[45] Jan. 31, 1978

[54] PROCESS FOR THE PREPARATION OF ACYLTAURIDES

[75] Inventor: Günther Boehmke, Leverkusen, Germany

[73] Assignee: Bayer Aktiengesellschaft, Leverkusen, Germany

[21] Appl. No.: 717,210

[22] Filed: Aug. 24, 1976

[30] Foreign Application Priority Data

Aug. 26, 1975 Germany ..... 2537914

[51] Int. Cl.[2] ..... C07C 143/90; C11D 1/28

[52] U.S. Cl. ..... 260/401

[58] Field of Search ..... 260/401

[56] References Cited

U.S. PATENT DOCUMENTS

| | | | |
|---|---|---|---|
| 2,857,370 | 10/1958 | Sundberg | 260/401 X |
| 2,880,219 | 3/1959 | Burnette | 260/401 |
| 2,974,153 | 3/1961 | Gajewski | 260/401 |
| 3,234,247 | 2/1966 | Abend et al. | 260/401 |

OTHER PUBLICATIONS

Rabjohn, "Organic Synthesis," vol. IV, (1963), pp. 513–514.

*Primary Examiner*—Winston A. Douglas
*Assistant Examiner*—John F. Niebling
*Attorney, Agent, or Firm*—Plumley and Tyner

[57] ABSTRACT

Preparation of acyltaurides of the general formula $$R - CO - NH - CH_2 - CH_2 - SO_3M$$

wherein

R denotes a $C_7$—$C_{21}$—alkyl or —alkenyl radical, which can be substituted by one or two hydroxyl groups, and M denotes an alkali metal or alkaline earth metal cation, ammonium or mono-, di- or tri-alkanolammonium, by reacting the corresponding fatty acids or their mixtures, urea and alkali metal hydroxyethanesulphonates or alkaline earth hydroxyethanesulphonates and, optionally by converting the reaction products into the ammonium or mono-, di- or tri-alkanolammonium salts.

5 Claims, No Drawings

PROCESS FOR THE PREPARATION OF ACYLTAURIDES

The preparation of fatty acid taurides has been described in a relatively large number of publications. The interest in this important category of surface-active agents can be seen from these publications. With regard to more rigorous selection of substances which are acceptable ecologically and toxicologically, attention has focussed increasingly on the acyltaurides.

However, an optimum solution with regard to the economics and ecology of the preparation has not yet been found.

Several processes for the preparation of acyltaurides from aminosulphonic acids are known from German Patent No. 655,999 and amongst these, in particular, the reaction with acid chlorides has been used industrially hitherto. However, several disadvantages arise with this process. Firstly, the acid chloride has to be prepared as an intermediate product. Handling of the acid chloride is hazardous and the by-products pollute the environment and the effluent. One mol of hydrochloric acid is always formed during the reaction with the taurides and this has to be bonded by alkali or amines. In addition, the salt in many cases impedes the broad applicability of the surface-active agents, such as, for example, the stability of plastic latices, or the fields of application in which the corrosion protection properties of the taurides are advantageous.

It is known from DT-AS (German Published Specification) 1,010,970 to prepare acyltaurides by reacting an excess of fatty acid with taurines in the melt. A particular disadvantage of this process is the insolubility of the salt-like taurines in the fatty acid melt, which prevents a reaction in the case of taurine itself, even with an excess of fatty acid. Only the alkyltaurines display better solubility and thus reactivity.

However, disadvantages can be observed even in the case of the alkyltaurines. The high temperature of 200°-320° C which is required for a reaction with the fatty acids already leads to the amine component being split off. Moreover, the preparation of the taurines by reacting alkylamines with sodium $\beta$-hydroxy-ethanesulphonate is technically very involved. Since it proceeds only at high temperatures (200° - 250° C), the reaction must be carried out under high pressures in order to counteract the decomposition mentioned.

For these reasons, investigations have also been disclosed in which an attempt was made to synthesise the acyltaurides by the elimination of water from fatty acid amides and the hydroxyethanesulphonate. A disadvantage of this procedure is, again, the insolubility of the salt-like compound in the fatty acid amides. The prior preparation of the fatty acid amides again signifies an additional effort. Fatty acid-free amides are, moreover, obtainable only via the fatty acid chlorides.

A known synthesis for fatty acid amides (Organic Synthesis IV (1963) page 513) proceeds via the reaction of urea with fatty acids with the elimination of ammonia and $CO_2$. It was also not possible to exceed the yield, which has been disclosed in the literature, of about 70% of theory of amide, in addition to free fatty acid, when the process was reproduced. The use of this fatty acid-containing amide for an acyltauride synthesis therefore did not seem to be very promising.

It has now been found that acyltaurides of the formula $$R\text{-}CO\text{-}NH\text{-}CH_2\text{-}CH_2\text{-}SO_3M \qquad \text{I}$$

wherein

R denotes a $C_7$-$C_{21}$-alkyl or-alkenyl radical, which can be substituted by one or two hydroxyl groups, and M denotes an alkali metal or alkaline earth metal cation, ammonium or mono-, di- or tri-alkanolammonium, are obtained in good yield and in the form of products which have an optimum solubility in water when corresponding fatty acids or their mixtures, urea and alkali metal hydroxyethanesulphonates or alkaline earth metal hydroxyethanesulphonates are reacted and, optionally, the reaction products are subsequently converted into the ammonium or mono-, di- or tri-alkanolamine salts. Ethanolamines or propanolamines are preferably employed as the alkanolamines. The reactants are employed in an approximately molar ratio, preferably in a ratio of fatty acid to urea to hydroxyethanesulphonate of 1 : 1-2 : 0.8 - 1.3.

The preferred reaction temperatures are 130° - 250° C, especially 140° - 210° C.

The sensitivity of the end products to high temperatures is slight, so that reaction temperatures of 250° - 280° C are possible. However, since a large amount of hydroxyethanesulphonate is still present at the start, it is appropriate, in order to prevent severe brown-black discolorations, for the temperature not quite to reach the decomposition temperature of the hydroxyethanesulphonate, that is to say about 215° - 220° C.

The reaction times are between 4 and 13 hours.

A preferred embodiment consists in first bringing the three reactants to 180° C and then bringing the temperature to 205° - 210° C in the course of 1 - 3 hours. The progress of the reaction can be followed by the increasing solubility in water, by the acid number and by the thin layer chromatogram.

An embodiment which is to be singled out in particular consists in stirring the fatty acid and urea at 130° - 140° C until a solution has formed. The hydroxyethanesulphonate is introduced into this homogeneous melt. After dissolving the slightly lipophilic salt in the organic phase, the reaction is brought to completion by heating to 180° - 240° C, preferably to 210°.

The taurides prepared according to the process of the invention can be employed as surface-active agents in a very wide field. For example, the insensitivity towards the hardness of water is an advantage when the taurides are used as washing agents and, when the reaction has not quite proceeded to completion, the fatty amides contained in the taurides act as softening agent for cellulose, polyacrylonitrile and also leather. Because they are free from salt, the products are suitable for use as emulsifiers and dispersing agents for plastic lattices. In fields of application which involve contact with metals, the corrosion protection properties of the taurides are not impeded by accompanying salts, as is usual when the known processes of preparation are used.

When used as dispersing agents, for example for disperse dyestuffs, advantages are not only the high efficiency, but also the biodegradability, of the products.

In principle, all fatty acids can be employed for the preparation. However, C-chain lengths of 8 - 22 are preferred for the preparation of surface-active agents. The fatty acids can be saturated, unsaturated or substituted by OH groups. Examples of pure acids which can be used are lauric acid, myristic acid, palmitic acid, stearic acid, arachic acid, oleic acid, elaidic acid, ricinoleic acid, erucic acid, hydroxystearic acid or dihydroxystearic acid. However, fatty acid mixtures having the composition occurring in the natural fats, for example coconut fatty acid, palm oil acid, palm-kernel fat, tallow fatty acid, soya oil acid, sunflower oil acid, rape oil acid, train oil acid and thistle oil acid, are preferably used.

It is advantageous, especially when using unsaturated fatty acids, if products which, by known methods, prevent the discoloration of the reaction products, for example 0.1 - 0.5% of dimethylphosphite, are added towards the end of the reaction.

As protection against oxidative discoloration it is advantageous to work under a blanketing gas and the $CO_2$ originating from the reaction is available for this purpose. However, it is also possible, for example, to use nitrogen.

EXAMPLE 1

216 g of coconut fatty acid (acid number = 260) are melted with 70 g of urea and 155 g of sodium hydroxyethanesulphonate. Whilst stirring and passing $CO_2$ gas over the mixture, the latter is heated to 180° C. The temperature is raised to 210° - 215° C in the course of 1 hour and this temperature is maintained for about 4 hours. A relatively wide opening must remain for the outgoing gas, since ammonium carbonate sublimes onto the colder parts of the apparatus. No further free fatty acid can be detected after about 2 hours. After 4 hours a product which is soluble in water, giving an opalescent solution, and which still contains amounts of fatty acid amide is obtained. The properties as a washing agent for wool and cotton are outstanding, even in hard water.

EXAMPLE 2

226 of myristic acid and 68 g of urea are heated to 135° - 140° C. When the fatty acid has melted, the mixture is stirred until the urea dissolved in the acid. 155 g of potassium hydroxyethanesulphonate are then introduced, nitrogen is passed into the reaction vessel and the temperature is raised to 210° C. After 8 hours a product which is readily soluble in water and which does not have an acid number (from free fatty acid) is obtained. The yield is about 380 g of myristic acid tauride. It can be used as a washing agent and as a dispersing agent for disperse dyestuffs.

EXAMPLE 3

270 g of technical grade oleic acid (acid number 210), 72 g of urea and 160 g of sodium hydroxyethanesulphonate are heated to 207° - 210° C, under nitrogen. The mixture is kept at this temperature for 12 hours, with strict exclusion of oxygen. About 430 g of a brownish melt which is soluble in water, giving a slightly opalescent solution, are obtained. The technical grade product is suitable as a dispersing agent for disperse dyestuffs during the dyeing process.

EXAMPLE 4

270 g of technical grade stearic acid (acid number 205) and 66 g of urea are melted and the melt is stirred at 130° - 140° C until the urea has dissolved. 153 g of sodium hydroxyethanesulphonate are introduced into the melt and the temperature is raised to 205° - 210° C. The mixture is kept at this temperature for about 12 hours. It is then allowed to cool to 130° - 140° C and the melt is poured out. The product can be finely ground in the customary manner. It is suitable as a washing agent for leather and wool and imparts a pleasant, soft and full handle to the materials.

EXAMPLE 5

The same amounts as used in Example 4 are reacted according to the same process; however, the reaction is discontinued after 4 hours at 210° C. The resulting reaction mixture can be dissolved in water to give an emulsion. 1 g/l of the substance can be added as a softener to a dyestuff of substantive dyestuffs for cotton. After the dyeing has been finished, the dye fabric exhibits a soft, full handle.

EXAMPLE 6

308 g of ricinoleic acid (calculated on 100% strength substance which, however, still contains about 15% of water from the saponification, in order to counteract the inner lactone formation) and 72 g of urea are heated, whilst stirring, to 135° - 140° C in such a way that the water can be distilled off. After about 1 hour at this temperature, 158 g of potassium hydroxyethansulphonate are introduced and the mixture is heated to 210° C. After 8 - 9 hours, the mixture is allowed to cool to 120° C and is made up to a 50% strength paste with 460 g of water at 70° C. The ricinoleic acid tauride can advantageously be used as an emulsifier for the preparation of plastics dispersions.

A comparable tauride is obtained when 320 g of dihydroxystearic acid are used in place of the ricinoleic acid.

I claim:

1. Process for the preparation of acyltaurides of the general formula:

$$R\text{-}CO\text{-}NH\text{-}CH_2\text{-}CH_2\text{-}SO_3M$$

wherein

R is $C_7$-$C_{21}$-alkyl or -alkenyl which is unsubstituted or mono- or di-substituted with hydroxyl; and M is an alkali metal or alkaline earth metal cation, ammonium, or mono-, di-, or tri-alkanol ammonium comprising reacting a corresponding fatty acid or mixtures thereof with an alkali metal or alkaline earth metal hydroxyethane sulfonate and urea, in a reaction medium consisting essentially of said corresponding fatty acid or mixtures thereof, said alkali metal or alkaline earth metal hydroxyethane sulfonate, and said urea.

2. The process of claim 1, wherein the acyltauride product is reacted with an ammonium compound or an alkanolamine to form the corresponding ammonium or mono-, di-, or tri-alkanolamine salt.

3. Process according to claim 1, characterised in that the reaction is carried out at 130° - 250° C.

4. Process according to claim 1, characterised in that the fatty acid, urea and the hydroxyethanesulphonate are employed in a molar ratio of 1 : 1-2 : 0.8 - 1.3.

5. Process according to claim 1, characterised in that the fatty acid and urea are stirred at 130° - 140° C. until a solution has formed, the hydroxyethanesulphonate is then added and the mixture is allowed to react at 180° - 240° C.

* * * * *